United States Patent [19]

Jacobsen

[11] 4,077,658

[45] Mar. 7, 1978

[54] TAMPER INDICATING SECURITY DEVICE FOR DRAWERS

[76] Inventor: Norman T. Jacobsen, 640 NW. 35th Ct., Fort Lauderdale, Fla. 33309

[21] Appl. No.: 700,549

[22] Filed: Jun. 28, 1976

[51] Int. Cl.[2] ..... E05C 19/18

[52] U.S. Cl. ..... 292/307 R

[58] Field of Search ..... 292/316, 317, 307, 318, 292/319, 325

[56] References Cited

U.S. PATENT DOCUMENTS

| | | | |
|---|---|---|---|
| 1,059,689 | 4/1913 | Webb | 292/319 |
| 2,998,154 | 8/1961 | Papy et al. | 292/325 X |
| 3,107,935 | 10/1963 | Erke | 292/325 |
| 3,591,223 | 7/1971 | Neto | 292/320 |

*Primary Examiner*—Richard E. Moore
*Attorney, Agent, or Firm*—Malin & Haley

[57] ABSTRACT

A device for securing removeable closures such as drawers, doors, and the like to prevent unacknowledged access to the closure which must be removed in order to gain access to the closure. A frangible member must be destroyed in order to remove the device. The device is useful during the transit of furniture such as cabinets, drawers, and desks in which valuable objects may be left during moving. The device includes a ribbon-like connector having one end tied to a drawer interlocking means and the other end tightly secured through a locking block housing. The locking block includes a removable top and a frangible locking plate which can only be removed by destroying the plate connector to allow the housing to be opened to release the ribbon-like connector and the drawer interlock. The device finds utility in securing one or more drawers which cannot be opened unless the device is removed by destroying the frangible indicator.

3 Claims, 5 Drawing Figures

TAMPER INDICATING SECURITY DEVICE FOR DRAWERS

BACKGROUND OF THE INVENTION

This invention relates generally to a device for retaining drawers in a closed position during transit which provides also a direct indication that the drawers have been opened or tampered with.

In recent years, theft has become an increased problem, especially in moving furniture and goods therein in transit. Moving companies have a difficult time protecting valuables which remain in chests, cabinets, desks, drawers and the like because unlocked drawers are readily accessible to an unauthorized person. It is also difficult to itemize all of the valuables in the drawers in transit, allowing for fraudulent insurance claims. To provide a padlock or other device could oftentimes damage the finish of the furniture which is undesirable.

The purpose of the instant invention is to provide a relatively non-complex drawer locking device which will not damage the furniture and which may be easily removed by an authorized person and which includes a destructible tag which must be destroyed to remove the drawer securing block. The removal of this tag or the removal of the locking block will provide a visual indication that the drawer has been tampered with or opened by an unauthorized person.

A thin ribbon of flexible fabric or material has a small engaging block connected at one end, the block having pointed spikes which engage the inside of the drawer framework. The opposite end of the ribbon-like fabric is received in a channel in a base member in a drawer securing locking box, the channel having pointed fasteners which penetrate and secure the fabric. The device includes a removable top which includes an upper block portion that forms the channel and allows the ribbon-like fabric to be received in the block itself. Once the chest of drawers, dresser or the like is received at the destination, an authorized person may quickly break the locking plate, remove the securing device without expending a great amount of time to unlock the drawers.

BRIEF DESCRIPTION OF THE INVENTION

A tamper indicating security device for preventing or indicating unauthorized access to a removable closure or receptacle such as a drawer, door or the like comprising a mounting block having a spaced channel for receiving a ribbon-like, flexible connector, said channel including a plurality of spiked ribbon engaging retainers, a cover plate which is mountable over the retaining block, said cover plate including a rigid spacing block received into the retaining block channel and a pair of slots, a cover retaining plate having a pair of flanged frangible members which are received over the cover plate through the notches in the plate which firmly engages the plate to the retaining block preventing access to the ribbon which is disposed and engaged within the block housing. The other end of the ribbon is affixed to an L-shaped spike containing gripping plate which is mounted inside of the desk drawer to engage the inside frame of the desk drawer.

To install the device, the gripping plate is mounted inside the drawer such that the spiked portions engage the inner wooden surface of the frame. The retaining block (with the cover plate removed) is placed adjacent the front surface of the drawer along the upper opening of the drawer and the furniture frame. The ribbon is pulled taughtly and the retaining block pressed against the drawer and upper surface. The ribbon is engaged with the spikes in the mounting block and the ribbon pulled down through the channel exiting the block. The cover plate is mounted over the face of the block which prevents access to the ribbon and prevents removal of the ribbon while the cover plate securing device is pressed through the apertures, firmly securing the cover plate in position. After this has been accomplished, the drawer cannot be opened without severing the ribbon or without removal of the cover plate. Removal of the cover plate securing means will cause destruction of the flanged connectors which are destroyed whenever the plate is removed. Thus, one will readily be able to determine whether or not the drawer has been opened by the condition of the cover plate securing device or the ribbon.

It is an object of this invention to provide a security device for drawers, removeable closures, and the like which prevents unauthorized access.

It is another object of this invention to provide a security device for drawers and the like which enables one to determine whether or not the drawer has been opened by an unauthorized person.

But yet still another object of this invention is to provide a security device for drawers and the like which is non-complex in construction and which is easily attached and removed by an authorized person and which will not mar or disfigure the article of furniture to which it is attached.

But yet still another object of this invention is to provide a tamper indicating device for use on drawers and other furniture which provides an indication that the drawer has been accessed by an unauthorized person.

In accordance with these and other objects which will be apparent hereinafter, the instant invention will now be described with particular reference to the accompanying drawings.

PREFERRED EMBODIMENT OF THE INVENTION

Figure 1:
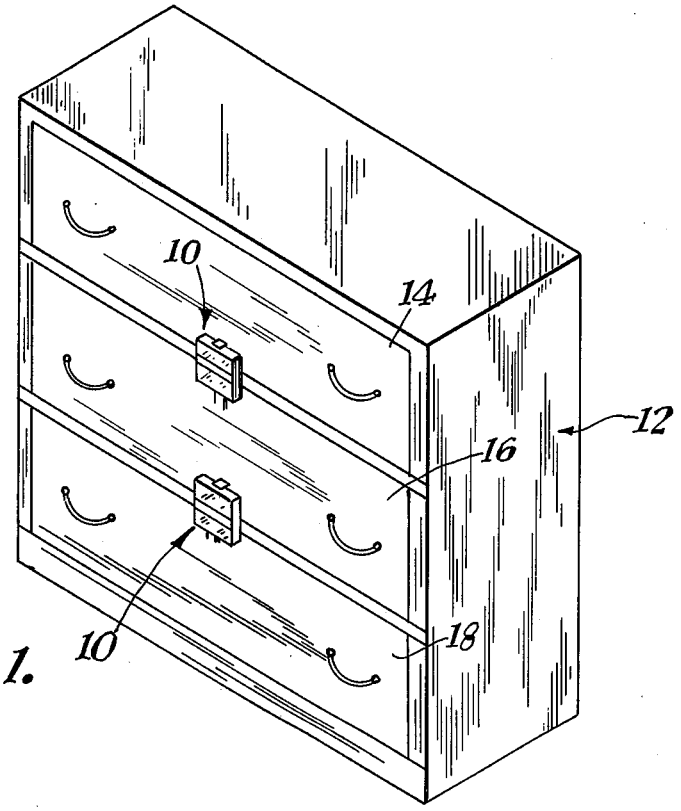
FIG. 1 shows a perspective view of an article of furniture with the instant invention attached thereto.

Referring now to the drawings and specifically to FIG. 1 a conventional chest of drawers 12 is shown with two of the instant invention shown generally at 10 attached thereto. In this position the drawers 14 and 16 and drawers 16 and 18 are firmly secured and cannot be opened unless the instant invention 10 is removed therefrom.

Figure 1A:
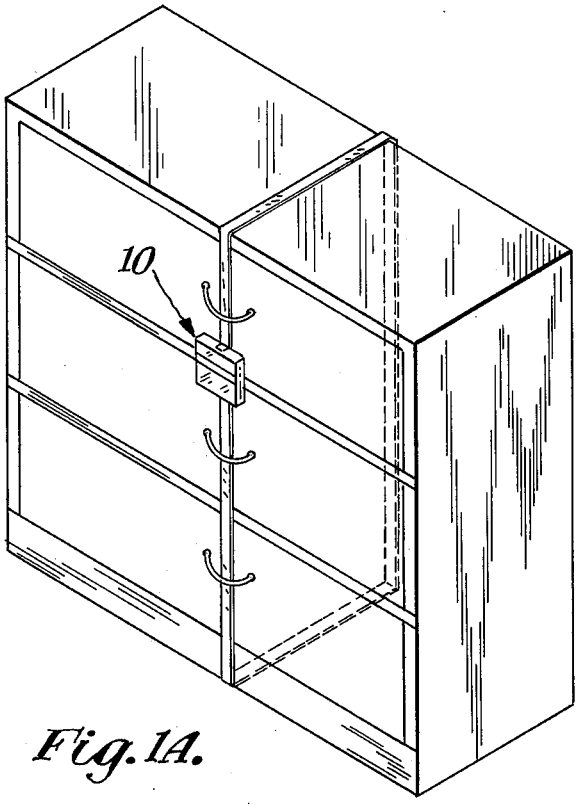
FIG. 1A shows an alternate embodiment of the instant invention.

FIG. 1A shows an alternate embodiment of the instant invention using only one device, with the ribbon deployed around the entire chest of drawers.

Figure 2:
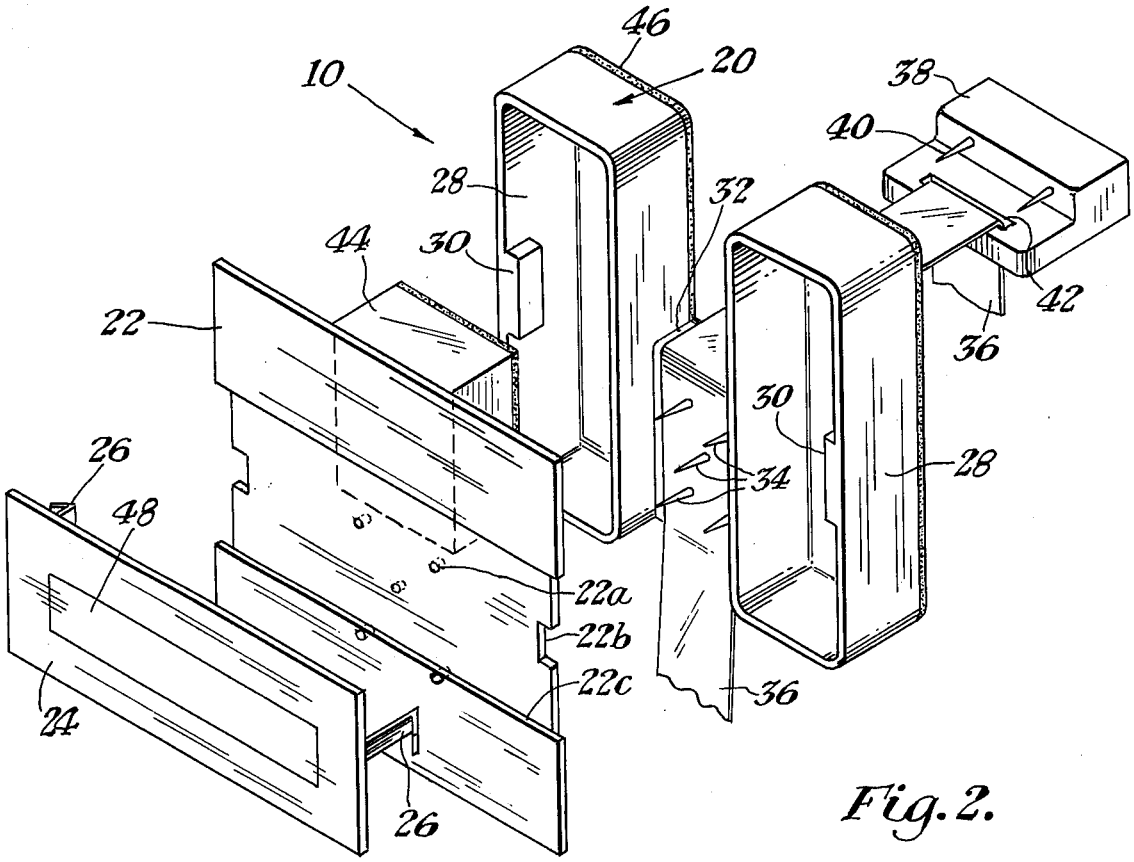
FIG. 2 shows an exploded, perspective view of the instant invention.

Referring now to FIG. 2 the instant invention is shown comprised of a retaining block housing generally at 20 having a pair of chambers 28 fixed together by rigid block 32 which has a plurality of sharp, pointed projections which perforate and engage a ribbon 36 which may be of fabric or other type material in the channel formed by the rigid block 32. Attached at one end of ribbon 36 is an L-shaped gripping plate 38 having a pair of pointed projections 40 and an aperture 42 which allows the ribbon to be secured and attached to the gripping plate 38. Inside each receptacle 28 is a flange locking block 30 which is described in greater detail below. A cover plate 22 is mounted over the retaining block and includes a plurality of apertures 22*a* which receive the pointed projections 34 when the cover plate 22 is in the engaging position. On each side of the cover plate 22 are notches 22*b* and a recess channel 22*c* which are utilized to affix the locking plates 24 which locks the cover plate 22 firmly to the retaining block housing 20. Disposed at each end of the locking plate 24 are a pair of frangible flanged projections 26 which are received through notches 22*b* in the cover plate 22 and engage the rear surface wall of flange locking block 30 to firmly hold the cover plate 22 to the block housing 20. An identification tag 48 may be adhesively attached to locking plate 24 to identify by number and carrier a particular shipment.

When the cover plate 22 is firmly locked to the retaining block housing 20 by the locking plate 24 such that the flange projections 26 engage the locking blocks 30, in channels 28, the cover plate 22 cannot be removed without removing the locking plate 24. Also in this disposition, the ribbon 36 cannot be removed from the block housing itself. The cover plate 22 includes a rigid channel forming block 44 which is disposed above and between the ribbon and retaining block housing 20 to permit a narrow opening which houses the ribbon 36. The flanged projections 26 are made of a destructable material such that the cover plate 22 can only be removed by destruction of the flanges which permits removal of the locking plate 24. Once the projections are destroyed, when the locking plate 24 is removed, the device then requires a new locking plate to engage the cover plate 22 in position. Thus if an unauthorized person removes the locking plate 24 by destroying the projection 26 this will show that the device has been tampered with and that someone has possibly gained access to a removeable drawer or closure.

Figure 3:
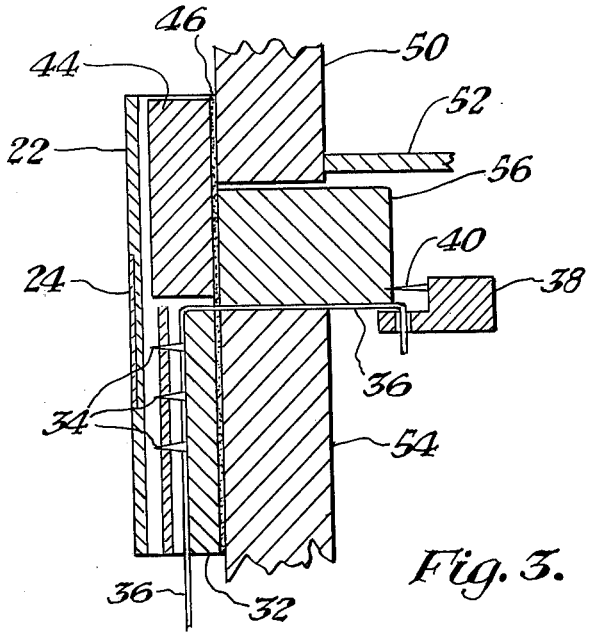
FIG. 3 shows a side elevational view in cross-section of the instant invention installed on an article of furniture to prevent unauthorized access to a drawer.

Referring now to FIG. 3, the instant invention is shown affixed to secure a pair of drawers with the upper drawer face 50 and the drawer bottom 52 disposed above the dresser frame 56 and the lower drawer front face 54. The L-shaped gripping plate 38 has the spiked projections 40 partially embedded in the inside face of frame 56 above the bottom drawer. Ribbon 36 has been pulled taut and securely anchored in the retaining block channel to the pointed projections 34 such that the block housing is disposed vertically and parallel with the front surfaces of the drawers. A soft material 46 is attached to the retaining block and protects the surface of the furniture from scratching. The ribbon 36, after receipt within the retaining block may then be cut at any desired length. The cover plate 22 is installed as is the blocking plate 24 such that the device now prevents drawers 50 and 54 from being opened without either destruction of ribbon 36 or removal of the cover plate 22.

Figure 4:
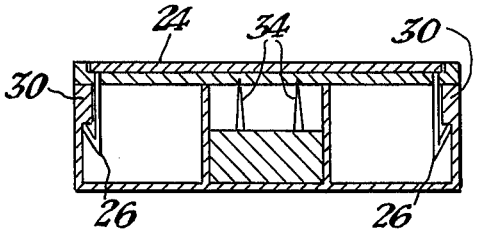
FIG. 4 shows a top plan view in cross-section of the restraining block utilized in the instant invention.

FIG. 4 shows how the locking plate 24 is secured to the retaining block by the flanged projections 26 engaging locking blocks 30. Since the flanged projections 26 are not accessable from the exterior of the housing, pulling off the locking plate 24 (since the material is destructable) causes the projections 26 to be broken providing an indication that someone has tampered with the securing block. The ribbon (not shown) can not be removed unless the cover plate 22 is removed.

The instant invention has been shown and described in what is considered to be the most practical and preferred embodiment. It is recognized, however, that departures may be made therefrom within the scope of the invention and that obvious modifications will occur to a person skilled in the art.

What I claim is:

1. A security device for locking a drawer or the like in a closed position which also provides an indication if someone has tampered with the device comprising:
   - a first chamber and a second chamber, each chamber having a raised wall portion;
   - a first block connected to one side of said first chamber and one side of said second chamber;
   - a plurality of spikes connected to one side of said first block, the pointed ends of the spikes being in the direction of the chamber openings of said first and second chambers;
   - a first and second chamber cover plate;
   - a second block connected to one side of said cover plate and sized to be received between said first and second chambers, said cover plate having a plurality of apertures for receiving the ends of said spikes, said cover plate having side notched portions;
   - a locking member, said locking member having a first and second resilient flange, each flange disposed at opposite ends connected to one side of said locking member, said first and second locking member flanges being receivable through the notches in the sides of said cover plate and connectable to said raised block wall portions within said first and second chamber, said first and second block being disposed to provide separation for receiving a ribbon therebetween in the closed position.

2. A security device, as in claim 1, including:
   - a soft pad connected to one side of said first chamber and said second chamber, said first block and said second block to provide a padded surface on said device being held adjacent said drawer face or the like.

3. A security device, as in claim 2, including:
   - a flexible ribbon receivable between said first chamber and said second chamber, and a means for fastening said ribbon to a planar surface, said ribbon being connected to said spikes on said first block.

* * * * *